US010701767B2

(12) United States Patent
Matsen et al.

(10) Patent No.: US 10,701,767 B2
(45) Date of Patent: Jun. 30, 2020

(54) INDUCTION HEATING CELLS WITH CONTROLLABLE THERMAL EXPANSION OF BLADDERS AND METHODS OF USING THEREOF

(71) Applicant: The Boeing Company, Chicago, IL (US)

(72) Inventors: Marc R. Matsen, Seattle, WA (US); Lee C. Firth, Renton, WA (US); Mark A. Negley, Kirkland, WA (US)

(73) Assignee: The Boeing Company, Chicago, IL (US)

( * ) Notice: Subject to any disclaimer, the term of this patent is extended or adjusted under 35 U.S.C. 154(b) by 336 days.

(21) Appl. No.: 15/841,964

(22) Filed: Dec. 14, 2017

(65) Prior Publication Data

US 2019/0191495 A1 Jun. 20, 2019

(51) Int. Cl.
*H05B 6/10* (2006.01)
*H05B 6/06* (2006.01)

(52) U.S. Cl.
CPC ..... *H05B 6/10* (2013.01); *H05B 6/06* (2013.01); *H05B 6/105* (2013.01)

(58) Field of Classification Search
CPC .. H05B 6/10; H05B 6/06; H05B 6/105; B29C 35/0805
USPC ..... 219/659; 264/403
See application file for complete search history.

(56) References Cited

U.S. PATENT DOCUMENTS 5,683,608 A 11/1997 Matsen et al.
6,747,253 B1 6/2004 Firth et al.
2005/0035115 A1 2/2005 Anderson et al.
2015/0013894 A1 1/2015 Matsen et al.
2015/0137427 A1 5/2015 Matsen et al.
2016/0354994 A1 12/2016 Meure et al.
2017/0144337 A1 5/2017 Matsen et al.

FOREIGN PATENT DOCUMENTS

WO 2015006301 A2 1/2015

OTHER PUBLICATIONS

Matsen, Marc R. et al., "Induction Heating Cells Comprising Tensioning Members Wth Non-Magnetic Metal Cores", U.S. Appl. No. 15/841,835, filed Dec. 14, 2017, 37 pgs.
Matsen, Marc R. et al., "Induction Heating Cells with Cauls over Mandrels Methods of Using Thereof", U.S. Appl. No. 15/841,918, filed Dec. 14, 2017, 35 pgs.
"European Application Serial No. 1816906.0, Search and Examination Report dated Apr. 5, 2019", 8 pgs.

*Primary Examiner* — Christine J Skubinna
(74) *Attorney, Agent, or Firm* — Kwan & Olynick LLP

(57) ABSTRACT

Disclosed herein are induction heating cells and methods of using these cells for processing. An induction heating cell may be used for processing (e.g., consolidating and/or curing a composite layup having a non-planar portion. The induction heating cell comprises a caul, configured to position over and conform to this non-planar portion. Furthermore, the cell comprises a mandrel, configured to position over the caul and force the caul again the surface of the feature. The CTE of the caul may be closer to the CTE of the composite layup than to the CTE of the mandrel. As such, the caul isolates the composite layup from the dimensional changes of the mandrel, driven by temperature fluctuations. At the same time, the caul may conform to the surface of the mandrel, which can be used to define the shape and transfer pressure to the non-planar portion.

26 Claims, 8 Drawing Sheets

INDUCTION HEATING CELLS WITH CONTROLLABLE THERMAL EXPANSION OF BLADDERS AND METHODS OF USING THEREOF

This invention was made with Government support under DE EE005780 awarded by Department of Energy. The government has certain rights in this invention.

BACKGROUND

Thermal processing of parts having low coefficient of thermal expansions (CTEs), e.g., less than $3\times10^{-6}$ m/(m*° C.), can be challenging. Most tooling materials, such as metals, have large CTEs, e.g., greater than $10\times10^{-6}$ m/(m*° C.). The CTE mismatch can results in shear forces applied to the surface of a processed part during heating or cooling, potentially causing wrinkling and other types of surface deformation. The processing becomes even more complicated when pressure is applied to the processed part by the tool during heating or cooling.

SUMMARY

Disclosed herein are induction heating cells with controllably expanded bladders and methods of using these cells for thermal processing of various parts, such as consolidating and/or curing composites having low CTEs. An induction heating cell comprises a die, an induction heater, and a bladder. The bladder comprises flat portions and an expansion feature. The expansion feature is disposed between the flat portions and extends at least in a direction substantially perpendicular to the flat portions. The flat portions are configured to contact and exert the pressure on the part while processing the part. The expansion feature has a variable height, which changes during temperature changes in the induction heating cell to accommodate the CTE mismatch between the bladder and the part. In some examples, the size, shape, boundaries, and/or other characteristics of the expansion feature may change during heating and cooling.

Provided is an induction heating cell for processing a part. In some examples, the induction heating cell comprises a die, an induction heater, and a bladder. The die is configured to receive the part and to support the part during its processing. The induction heater is configured to generate a magnetic field and to heat the part, directly and/or indirectly, while processing the part. The bladder is configured to applying uniform pressure to the part. Specifically, the bladder comprises flat portions and an expansion feature, disposed between the flat portions extending at least in a direction substantially perpendicular to the flat portions. The flat portions are configured to contact e.g., directly contact) the part and exert the pressure on the part while processing the part. The expansion feature has a height, extending in the direction substantially perpendicular to the flat portions. The height is configured to change while heating the part. In some examples, one or more other characteristics of the expansion feature change as well.

In some examples, the distance between the flat portions, separated by the expansion feature, is configured to change while heating the part. In the same or other examples, the flat portions are configured to at least partially transition into the expansion feature while heating the part. The flat portions and the expansion feature may be monolithic. For example, the flat portions and the expansion feature are formed by a continuous sheet. In some examples, the bladder is formed from a metal (e.g., aluminum) or a metal alloy (e.g., an aluminum alloy), The expansion feature may have one of a trapezoid cross-sectional shape or a loop cross-sectional shape.

In some examples, the induction heating cell further comprises a caul directly interfacing the flat portions of the bladder. The caul and the expansion feature may form an expansion pocket, isolated by the caul from the part. The caul may be a continuous sheet overlapping with multiple expansion features, comprising the expansion feature.

Also provided is a method of processing a part. In some examples, the method of processing comprises a step of positioning a part between a die and a bladder of an induction heating cell. The method of processing comprises a step of applying pressure to the part using the die (1100) and the bladder. The method of processing comprises a step of heating the part using an induction heater of the induction heating cell. During the step of heating the part, the overall length increase of the part in one direction is substantially identical to an overall length increase of the bladder in the same direction. The coefficient of thermal expansion (CTE) of the bladder may be different from the CTE of the part. The CTE of the bladder is at least two times greater than the CTE of the part. For example, the bladder is formed from a metal or a metal alloy, and wherein the part is a composite part. More specifically, the part comprises a carbon reinforced organic matrix composite.

In some examples, the bladder comprises flat portions and an expansion feature, disposed between the flat portions and extending in a direction substantially perpendicular to the flat portions. The flat portions contact the part and apply the pressure on the part. The expansion feature has a height in the direction substantially perpendicular to the flat portions. The height of the expansion feature changes during the step of heating the part. In some examples, the distance between the flat portions, separated by the expansion feature, changes during the step of heating the part. The flat portions may at least partially transition into the expansion feature while during the step of heating the part. The flat portions and the expansion feature may be monolithic. For example, the flat portions and the expansion feature are formed by a continuous sheet. The cross-sectional shape of the expansion feature changes during the step of heating the part.

In some examples, the induction heating cell further comprises a caul disposed between the part and the expansion feature. The caul may directly interface the part. The caul may be disposed between the flat portions and the part. Alternatively, the flat portions may directly interface the part. In some examples, the caul and the expansion feature form an expansion pocket, isolated by the caul from the part.

DETAILED DESCRIPTION

In the following description, numerous specific details are set forth in order to provide a thorough understanding of the presented concepts. The presented concepts may be practiced without some or these specific details. In other instances, well known process operations have not been described in detail so as to not unnecessarily obscure the described concepts. While some concepts will be described in conjunction with the specific examples, it will be understood that these examples are not intended to be limiting.

Introduction

Figure 1A:
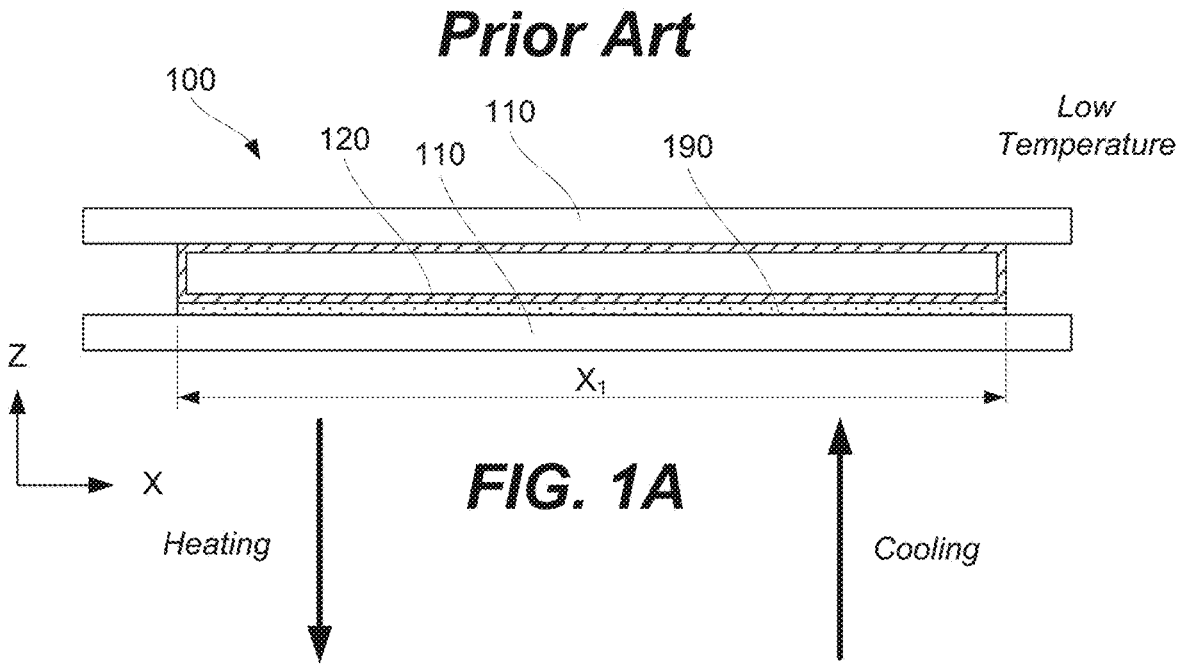
FIGS. 1A-1D illustrate induction heating cells undergoing heating and cooling, in accordance with some examples.
Figure 1B:
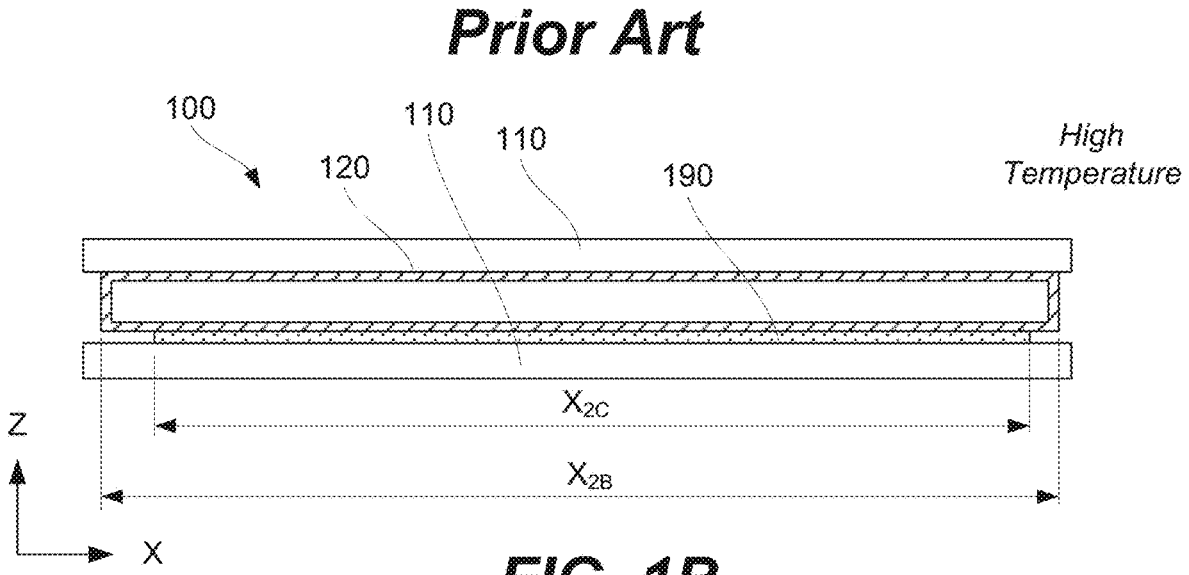

An induction heating cell is used for applying pressure and heat to a processed part. For example, as shown in FIG. 1A, processed part 190 may be positioned between die 110 and bladder 120 of induction heating cell 100 and heated inside induction heating cell 100 using, for example, a magnetic field. As further described below, the heating may be directed, e.g., when part 190 is susceptible to the magnetic field, and/or indirect, e.g., when part 190 is thermally coupled to another component of induction heating cell 100 that is susceptible to the magnetic field. When the CTE of part 190 and the CTE of bladder 120 are substantially different, the heating causes different levels of expansion of part 190 and bladder 120, especially, when part 190 is large. The difference is schematically shown by FIGS. 1A and 1B. The initial size of both part 190 and bladder 120 (in the X direction) is shown to be $X_1$ in FIG. 1A. Referring to FIG. 1B, during heating, part 190 expands to a new size $X_{2C}$, while bladder 120 expands to a different size $X_{2B}$, which is larger than $X_{2C}$. For example, processed part 190 may be a graphite reinforced composite with a CTE of about $2\times10^{-6}$ m/(m*° C.). Bladder 120 may be formed from an aluminum or, more specifically, from an aluminum alloy with a CTE of about $22\times10^{-6}$ m/(m*° C.). Therefore, for each meter in one direction and the increase in temperature of 100° C., bladder 120 will expand 2 millimeters more than part 190. This expansion difference coupled with the pressure exerted by bladder 120 onto processed part 190 may cause wrinkling in part 190 and, in some instances, fiber waviness (e.g., when the part is a composite comprising fibers).

Figure 1C:
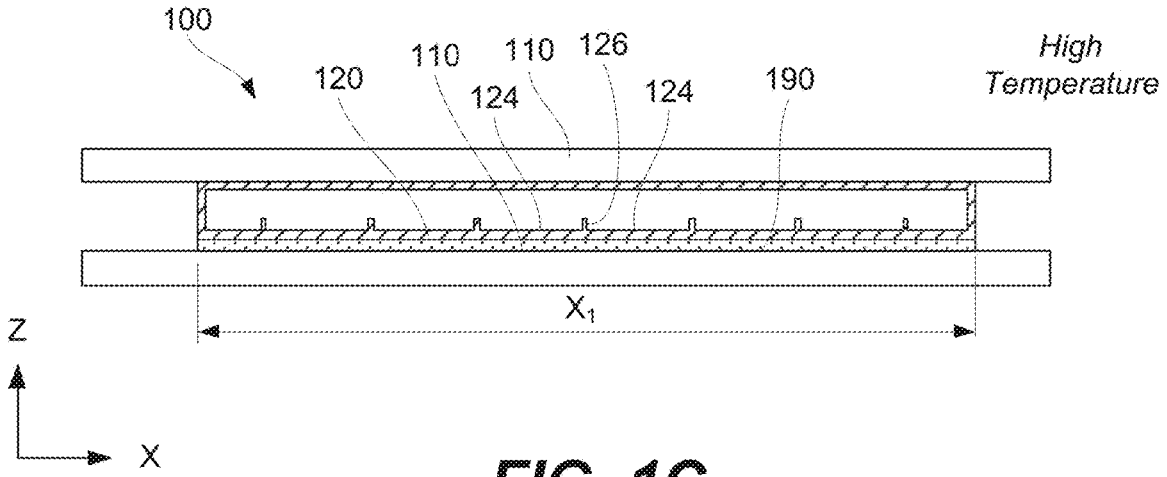
Figure 1D:
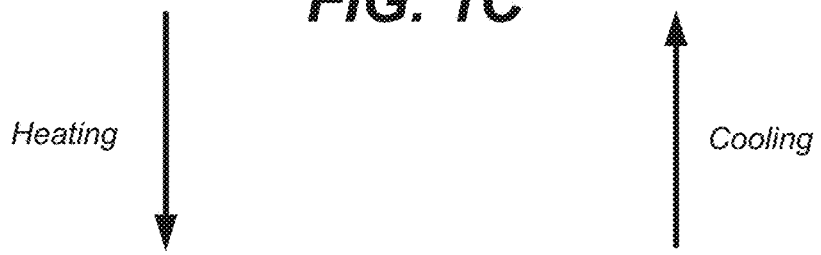
Figure 1D:
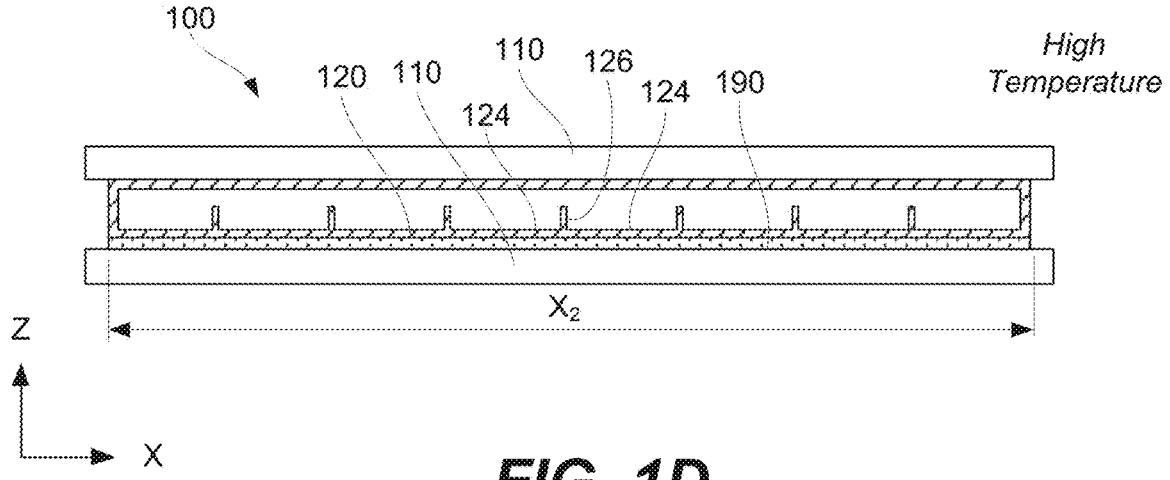

It has been found that bladder 120 equipped with one or more expansion features 126 as, for example, schematically shown in FIGS. 1C and 1D may mitigate issues associated with conventional bladders having continuous surfaces interfacing processed parts. Specifically, bladder 120, described herein and shown in FIGS. 1C and 1D, comprises flat portions 124 and expansion features 126, each expansion features 126 disposed between two adjacent flat portions 124. Expansion features 126 extend, at least in part, in the direction substantially perpendicular to the surface flat portions 124 (the Z direction in FIGS. 1C and 1D). Flat portions 124 are configured to contact and exert pressure onto part 190. Each expansion feature 124 has a height, extending in the direction substantially perpendicular to flat portions 124 (the Z direction). The height is configured to change while heating and cooling part 190 (transition between the state shown in FIG. 1C and the state shown in FIG. 1D).

Adding one or more expansion features 126 to bladder 120 mitigates the CTE difference between bladder 120 and processed part 190. In some examples, during heating and cooling of bladder 120 and part 190, the overall change in their respective sizes may be substantially the same. As shown in FIG. 1C, the initial size of both bladder 120 and part 190 is $X_1$ (in the X direction). After heating, as shown in FIG. 1D, the resulting size of both bladder 120 and part 190 is $X_2$ (in the X direction), even though the CTE of bladder 120 and part 190 are different. In these examples, expansion features 126 may change their height and, in some examples, other characteristics to accommodate more expansion or contraction associated with flat portion 124 thereby keeping the overall change in size the same. These and other features are as further described below.

Induction Heating Cell Examples

Figure 2A:
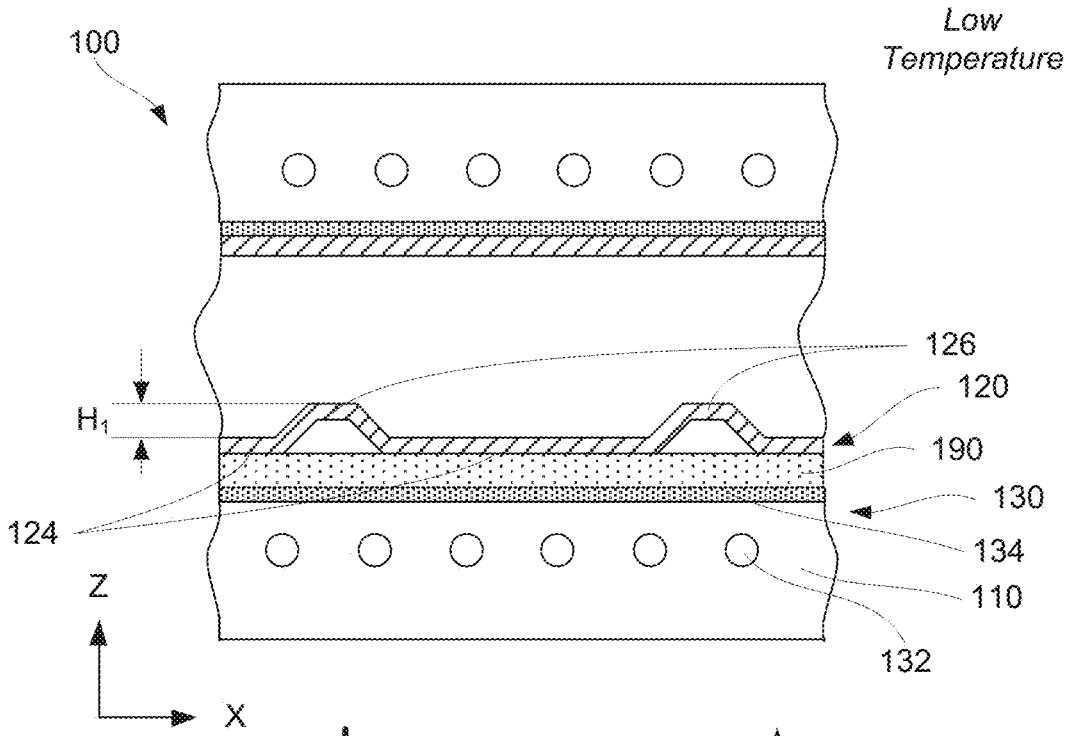
FIGS. 2A-2B illustrate an induction heating cell with a controllably expanding bladder, in accordance with some examples.

FIG. 2A illustrates an example of induction heating cell 100 for processing part 190. As shown in this example, induction heating cell 100 comprises die 110, induction heater 130, and bladder 120. Die 110 is configured to receive part 190. In some examples, part 190 directly interfaces die 110. Alternatively, another component (e.g., susceptor 134 of induction heater 130) may be positioned between part 190 and die 110. In either case, die 110 may define at least some of the shape of part 190. Die 110 may also support part 190 during operation of induction heating cell 100 and supply pressure onto part 190.

In some examples, die 110 is made from a material not susceptible to inductive heating or, more specifically, not susceptible to the magnetic field generated by induction heater 130. The material of die 110 may have a low CTE (e.g., comparable to the CTE of part 190), good thermal shock resistance, and relatively high compression strength. Some examples of materials suitable for die 110 include composites and/or ceramics. A specific example is a silica ceramic or, even more specific, castable fused silica ceramic. In some examples, one or two dies 110 are positioned between bolsters (not shown) used for supporting dies 110 and controlling the position of dies 110 relative to each other.

Induction heater 130 is configured to generate a magnetic field and heat part 190 during operation of induction heating cell 100. In some examples, induction heater 130 comprises induction coils 132 (e.g., solenoidal type induction coils) as, for example, shown in FIG. 2A. Induction coils 132 are configured to generate a magnetic field. Induction heater 130 may also comprise one or more susceptors 134, which are thermally coupled to part 190. For example, FIG. 2A illustrates part 190 directly interfacing susceptor 134. In some examples, susceptor 134 is formed from a ferromagnetic alloy and may be referred to as a smart susceptor. This type of susceptor 134 uses the Curie point to enact an intrinsic thermal control effect to the process.

Inductive heating is accomplished by providing an alternating electrical current to induction coils 132. This alternating current produces an alternating magnetic field near part 190 and/or susceptor 134. The heat is generated in one or more of these components via eddy current heating, which may be also referred to as inductive heating. In some examples, part 190 is heated directly by the magnetic field, which may be referred to as direct inductive heating. For example, part 190 may comprise graphite or boron reinforced organic matrix composites, which are sufficiently susceptible to magnetic fields. In some examples, susceptor 134 is used for indirect heating of part 190, in addition to or instead of direct inductive heating of part 190. Specifically, susceptor 134 is inductively heated and then transfers heat to part 190, which is thermally coupled to susceptor 134. This type of heating may be referred to as indirect heating. The frequency at which the coil driver drives induction coils 132 depends upon the nature of part 190 and/or susceptor 134 as well as processing parameters, and other factors. For example, the current penetration of copper at 3 kHz is approximately 1.5 millimeters, while the current penetration at 10 kHz is approximately 0.7 millimeters. The shape of induction coils 132 is used for controlling the magnetic field uniformity and, as a result, the heating/temperature uniformity.

The pressure is provided by combined operations of one or more dies 110 and bladder 120. For example, as shown in FIGS. 1A-1D, induction heating cell 100 include two dies 110. Changing the space between these dies 110, available for part 190 and bladder 120, may be used to increase or decrease the pressure inside bladder 120 and the pressure which bladder 120 and one of dies 110 act on part 190. Furthermore, the gas may be pumped into or from bladder 120 to control the pressure. Specifically, bladder 120 may be connected to a gas source, pump, valve, and the like.

In some examples, bladder 120 may be formed from a metal or a metal alloy (e.g., aluminum or an aluminum alloy, magnesium or a magnesium alloy), a polymer, or other like materials. Specific characteristics of bladder 120 include an ability to hold pressure, thermal stability, flexibility, conformity, and specific thermal expansion characteristics (which are further described below). The flexibility of bladder 120 provides an even distribution of pressure and conform, for example, to ply drops or other features of part 190.

Referring to FIG. 2A, bladder 120 comprises flat portions 124 and one or more expansion features 126. Flat portions 124 are configured to contact and exert pressure on part 190 while processing part 190. As such, the shape of flat portions 124 may be defined at least in part by the shape of part 190 or, more specifically, the shape of the surface of part 190 contacting bladder 120. In some examples, flat portions 124 may be substantially planar. Alternatively, flat portions 124 may be non-planar. However, unlike expansion features 126, which have a high degree of curvature, the curvature of flat portions 124 is minimal, e.g., less than 100 millimeters.

Any number of expansion features 126 may be present in bladder 120, e.g., one, two, three, and the like. When multiple expansion features 126 are used, these expansion features 126 may be evenly distributed in one direction (e.g., the X direction) or two directions (e.g., the X and Y directions). Each expansion feature 126 is disposed between two adjacent flat portions 124.

Referring to the cross-section of expansion feature 126 shown in FIG. 2A, expansion feature 126 extends in a direction substantially perpendicular to flat portions 124 (the Z direction in FIG. 2A). In other words, during operation of induction heating cell 100, expansion feature 126 extends away from part 190. It should be noted that expansion feature 126 (referring to the cross-section of expansion feature 126 as, for example, shown in FIG. 2A) may further extend in other directions, in addition to the direction substantially perpendicular to flat portions 124. Furthermore, expansion feature 126 may extend in a direction perpendicular to the plane of the cross-section shown in FIG. 2A (e.g., the Y direction). The cross-section of expansion feature 126 may be constant or variable in that direction.

Figure 2B:
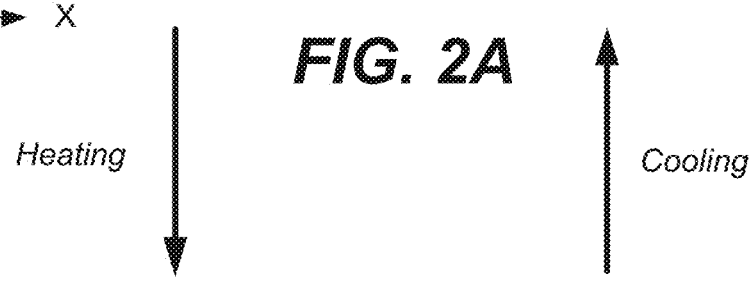
Figure 2B:
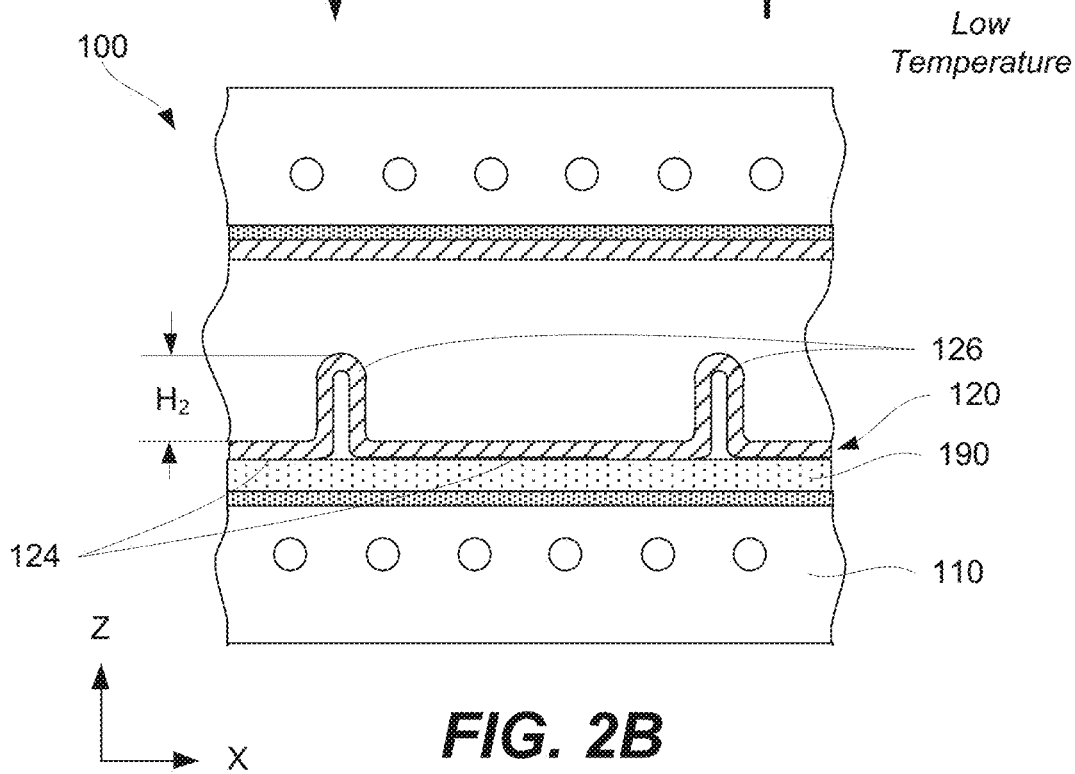

Expansion feature 126 has a height ($H_1$ in FIG. 2A or $H_2$ in FIG. 2B), extending in the direction substantially perpendicular to flat portions 124 (the Z direction in FIG. 2A). The height is configured to change or, more specifically, to increase while heating part 190 (e.g., $H_1$ in FIG. 2A is smaller than $H_2$ in FIG. 2B). For example, FIGS. 2A and 2B represent bladder 120 at two different temperatures with FIG. 2A corresponding to a lower temperature and FIG. 2B corresponding to a higher temperature. The height of expansion feature 126 at the lower temperature ($H_1$ in FIG. 2A) is smaller than the height of the same expansion feature 126 at the higher temperature ($H_2$ in FIG. 2B). This change in height is used to compensate for the large CTE of bladder 120 in comparison to the CTE of part 190. Instead of the entire increase in the dimension of bladder 120 happening in the X direction as in conventional bladders, some increase happens in the Z direction. In other words, the dimensional change of bladder 120 due to temperature variations occur in at least two directions (looking at the cross-section presented in FIGS. 2A and 2B). Because of this two-directional expansion of bladder 120, the overall expansion of bladder 120 in the X direction may be kept like the overall expansion of part 190 in the same X direction even though the CTE of bladder 120 may be much higher than the CTE of part 190.

Figure 2C:
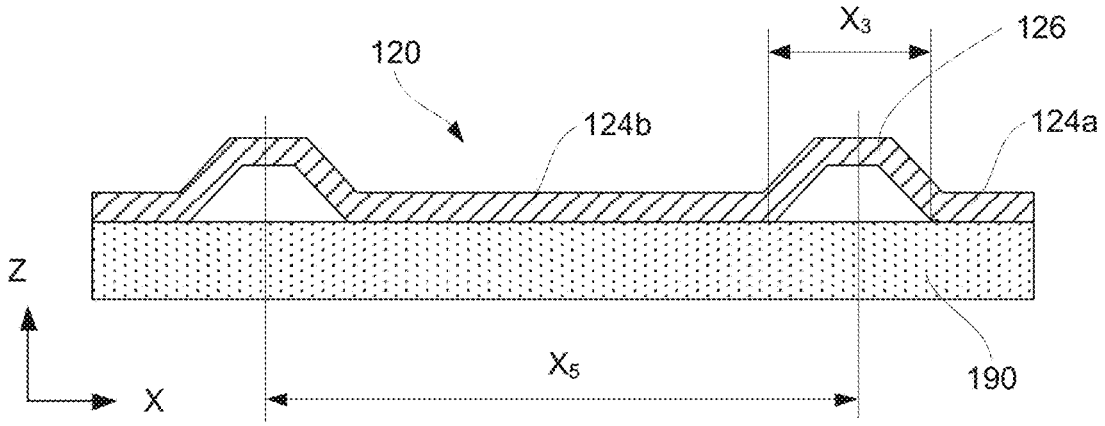
FIGS. 2C-2F illustrate different examples of expansion features of the controllably, expanding bladder.
Figure 2D:
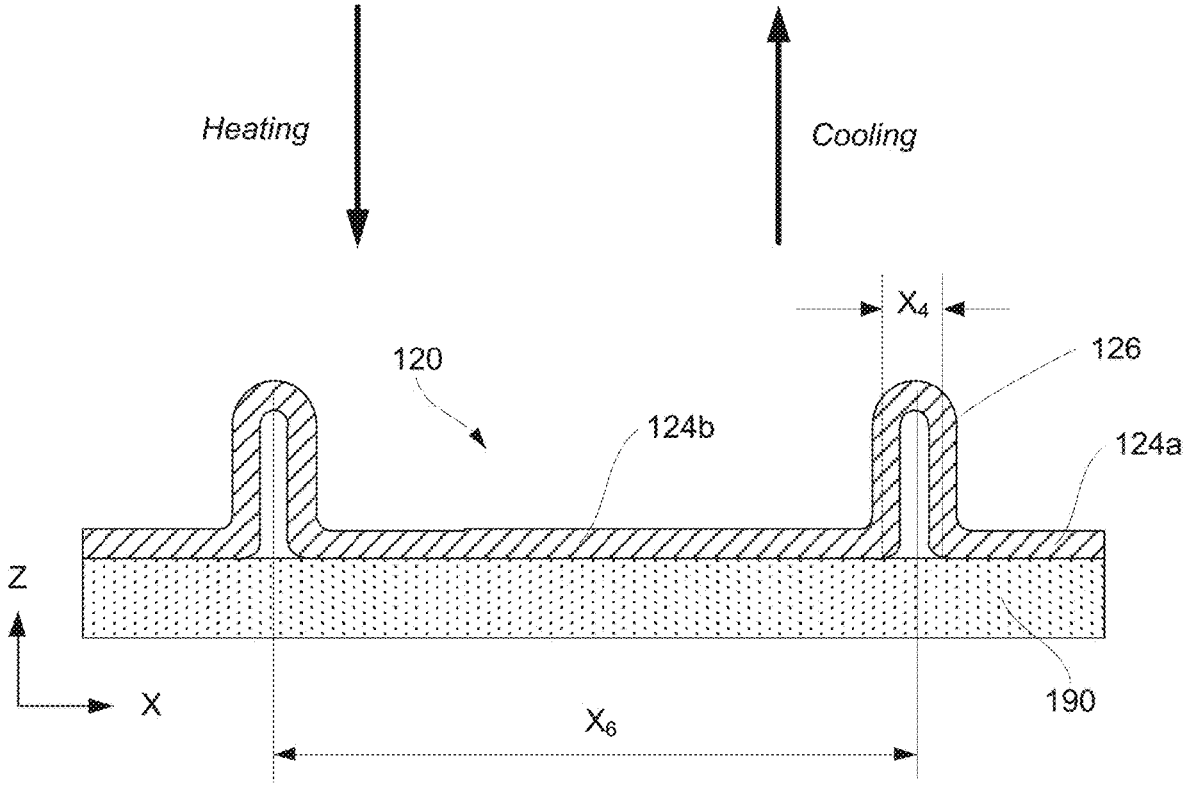

Referring to FIGS. 2C and 2D, another aspect of managing the CTE mismatch is controlling the distance ($X_3$ and $X_4$) between two adjacent flat portions 124*a* and 124*b*, which are separated by expansion feature 126. In some examples, this distance is configured to change when bladder 120 and part 190 are heated or cooled as, for example, schematically shown by FIGS. 2C and 21). This change may be used to accommodate the change in length of flat portions 124*a* and 124*b*. In some embodiments, the distance ($X_5$ and $X_6$) between two adjacent expansion features 126 may remain substantially the same during heating and cooling despite the change in length of flat potion 124*b* disposed between these two adjacent expansion features 126. Alternatively, the distance ($X_5$ and $X_6$) between two adjacent expansion features 126 may change at the same rate as the change experienced by part 190. In these examples, expansion features 126 do not shift along the X axis relative to part 190 during temperature changes.

Figure 2E:
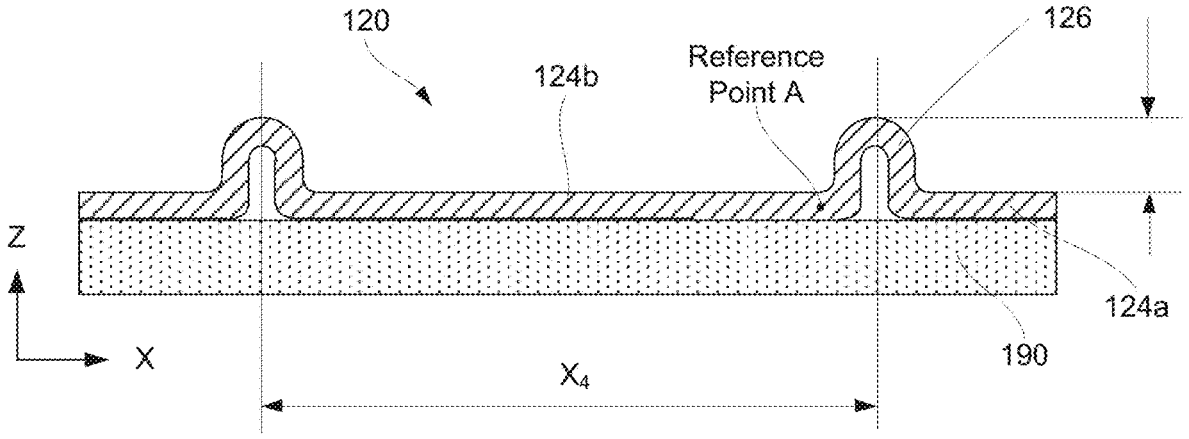
Figure 2F:
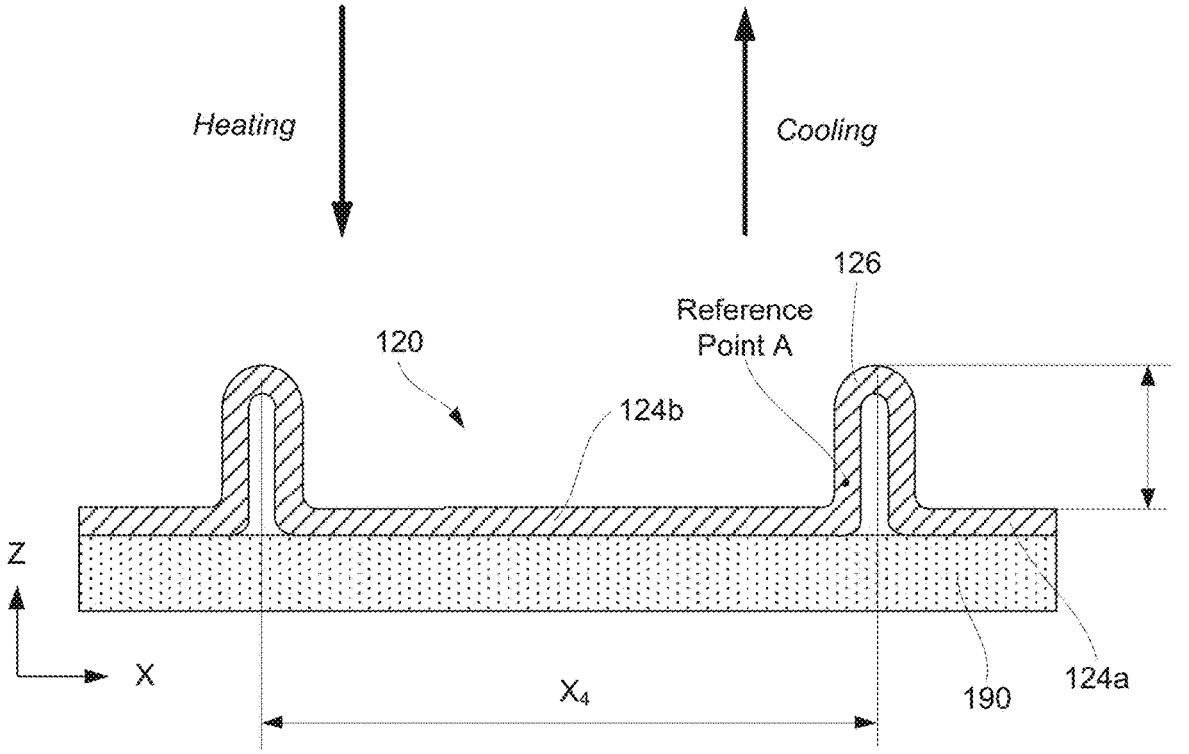

In some example, flat portions 124 and expansion feature 126 may be monolithic. For example, flat portions 124 and expansion feature 126 are formed by a continuous sheet. In these or other examples, flat portions 124 may be configured to at least partially transition into expansion feature 126 while heating part 190 as, for example, shown in FIGS. 2E and 2F. Specifically, FIG. 2E illustrate reference point A positioned on flat portion 124*b*. As the length of this flat portion 124*b* increases when bladder 120 is heated, flat portions 124*b* partially transitions into expansion feature 126 and reference point A moves to expansion feature 126. When bladder 120 is cooled, the reverse process happens, and reference point A moves back flat portion 124*b* as a part of expansion feature 126 partially transitioning into flat portions 124*b*.

Expansion feature 126 may have various shapes and may change its shape when bladder 120 is heated or cooled. For example, expansion feature 126 may have one of a trapezoid cross-sectional shape or a loop cross-sectional shape as, for example, shown in FIGS. 2C and 2D.

Figure 3A:
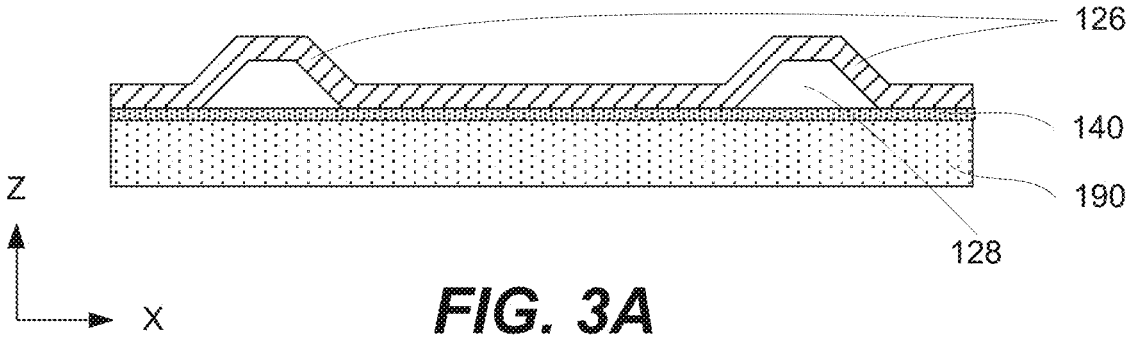
FIGS. 3A-3B illustrate different examples of expansion features of the controllably expanding bladder isolated from a processed part by a caul.
Figure 3B:
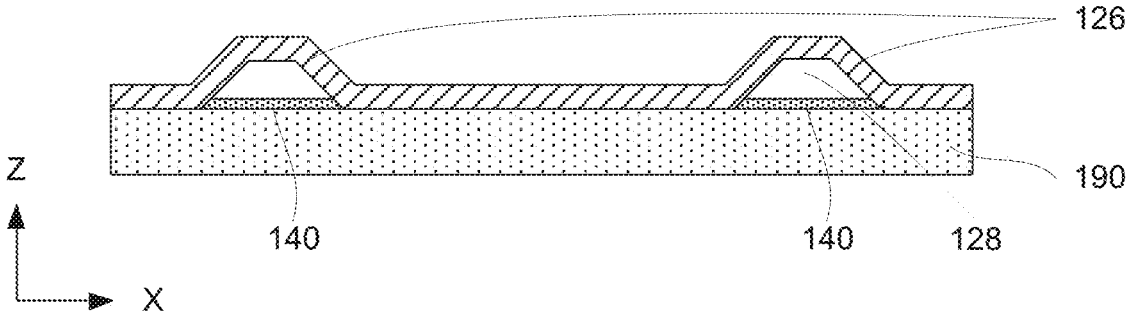

Referring to FIGS. 3A and 3B, in some examples, induction heating cell 100 further comprises caul 140 directly interfacing flat portions 124 of bladder 120. Caul 140 and expansion feature 126 may form expansion pocket 128, isolated by caul 140 from part 190. Caul 140 may be a continuous sheet overlapping with multiple expansion features, comprising expansion feature 126.

Processing Examples

Figure 4:
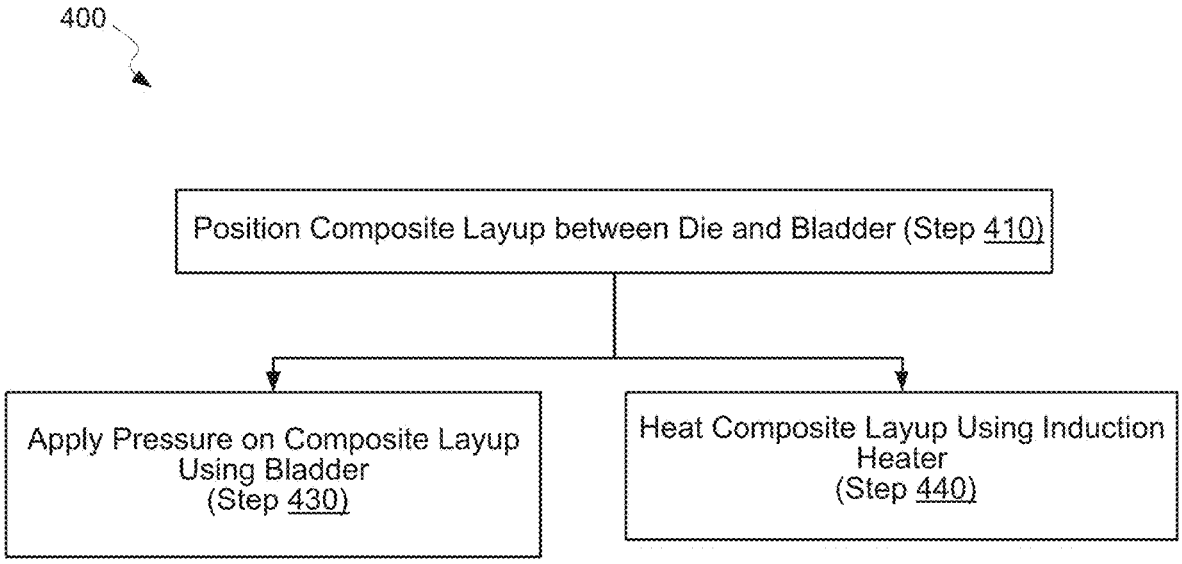
FIG. 4 is a process flowchart of processing a part using an induction heating cell with a controllably expanding bladder, in accordance with some examples.

FIG. 4 illustrates a process flowchart corresponding to method of processing 400 part 190, in accordance with some example. Method of processing 400 uses induction heating cell 100, various examples of which are described above. Part 190 may be a composite part or any other part. In some examples, part 190 comprises at least one of braided thermoplastic material, tacked thermoplastic material, or any other suitable thermoplastic material.

In some examples, method of processing 400 comprises step of positioning 410 part 190 between die 110 and bladder 120 of induction heating cell 100. FIG. 2A illustrates an example of part 190 disposed over die 110 or, more specifically, disposed over susceptor 134 positioned over die 110. In some examples, part 190 may be positioned onto bladder 120. After this step, part 190 may directly interface die 110 and/or susceptor 134. In some examples, the surface of die 110 and/or susceptor 134 interfacing part 190 define the shape of this portion of part 190. While FIG. 2A illustrates the bottom surface of part 190 being planar, one having ordinary skill in the art would understand that different kinds of shapes are within the scope.

Various positioning techniques may be used during this step. For example, part 190 may be positioned using at least one of braiding, tape layup, tow layup, or any other desirable composite layup technique. Furthermore, this step may involve laser assisting to ensure precise positioning of individual parts (e.g., plies) forming part 190.

Method of processing 400 comprises step of applying 430 the pressure to part 190. The pressure is applied using die 1100 and bladder 120. For example, the space occupied by bladder 120 may be reduced to increase the pressure inside bladder 120 (e.g., the space between two dies may be reduced). In the same or other example, a gas may be supplied into bladder 120 to increase its pressure.

When part 190 is a braided thermoplastic material, slits of part 190 may move relative to each other during this step. Movement of the braided slits of part 190 may improve the quality of the resulting part. When bladder 120 is pressurized, dies 110 provide resistant pressure. In other words, dies 110 may provide a substantially rigid outer mold line.

As described above with reference to FIG. 2A, bladder 120 comprises flat portions 124 and expansion feature 126, disposed between flat portions 124 and extending in the direction substantially perpendicular to flat portions 124. Flat portions 124 contact and apply pressure on part 190 during step 430. Expansion portion 126 protrudes away from part 190 and does not contact part 190.

Returning to FIG. 4, method of processing 400 comprises step of heating 440 part 190 using induction heater 130 of induction heating cell 100. For example, induction coil 132 may generate a magnetic field, which interacts with part 190 directly (e.g., when part 190 is susceptible to the magnetic field) and/or with susceptor 134 (e.g., when susceptor 134 is used). Specifically, when susceptor 134 is used, step of heating 440 part comprises step of inductively heating 362 susceptor 144 of induction heater 130 using the magnetic field. Susceptor 144 is thermally coupled to part 190 and transfers generated heat to part 190. Various examples of direct and indirect heating of part 190 are also described below. In some examples, step of heating 440 part 190 comprises inductively heating caul 140. Like part 190 and/or susceptor 134, caul 140 is inductively heated using the magnetic field generated by induction heater 130.

During step of heating 440, the overall length increase of part 190 in one direction may be substantially identical to the overall length increase of bladder 120 in the same direction as, for example, schematically shown in FIGS. 1C and 1D. In this example, the CTE of bladder 120 is still different from the CTE of part 190. For example, the CTE of bladder 120 may be at least two times greater than the CTE of part 190 (e.g., bladder 120 is formed from a metal or a metal alloy, and wherein part 190 is a composite part). The CTE mismatch is mitigated by expansion feature 126, which may change their height, shape, and/or other characteristics during step of heating 440 as described above.

In some examples, step of heating 440 and step of applying 430 the pressure overlaps in time. As part 190 is heated and compressed, thermoplastic materials of part 190 may be consolidated. For example, the resin of part 190 flows and solidifies. In some examples, step of heating 440 and step of applying 430 forms a cured part from processed part 190. Some examples of the cured part include a wing component comprising a stiffener, a flight control surface, and a fuselage door. It should be noted that composite materials are used in aircraft to decrease the weight of the aircraft. This decreased weight improves performance features such as payload capacity and fuel efficiency. Further, composite materials provide longer service life for various components in an aircraft.

Although the illustrative examples for an illustrative example are described with respect to an aircraft, an illustrative example may be applied to other types of platforms. The platform may be, for example, a mobile platform, a stationary platform, a land-based structure, an aquatic-based structure, and a space-based structure. More specifically, the platform, may be a surface ship, a tank, a personnel carrier, a train, a spacecraft, a space station, a satellite, a submarine, an automobile, a power plant, a bridge, a dam, a house, a windmill, a manufacturing facility, a building, and other suitable platform.

Aircraft Examples

While the systems, apparatus, and methods disclosed above have been described with reference to aircraft and the aerospace industry, it will be appreciated that the embodiments disclosed herein may be applied to any other context as well, such as automotive, railroad, and other mechanical and vehicular contexts.

Figure 5:
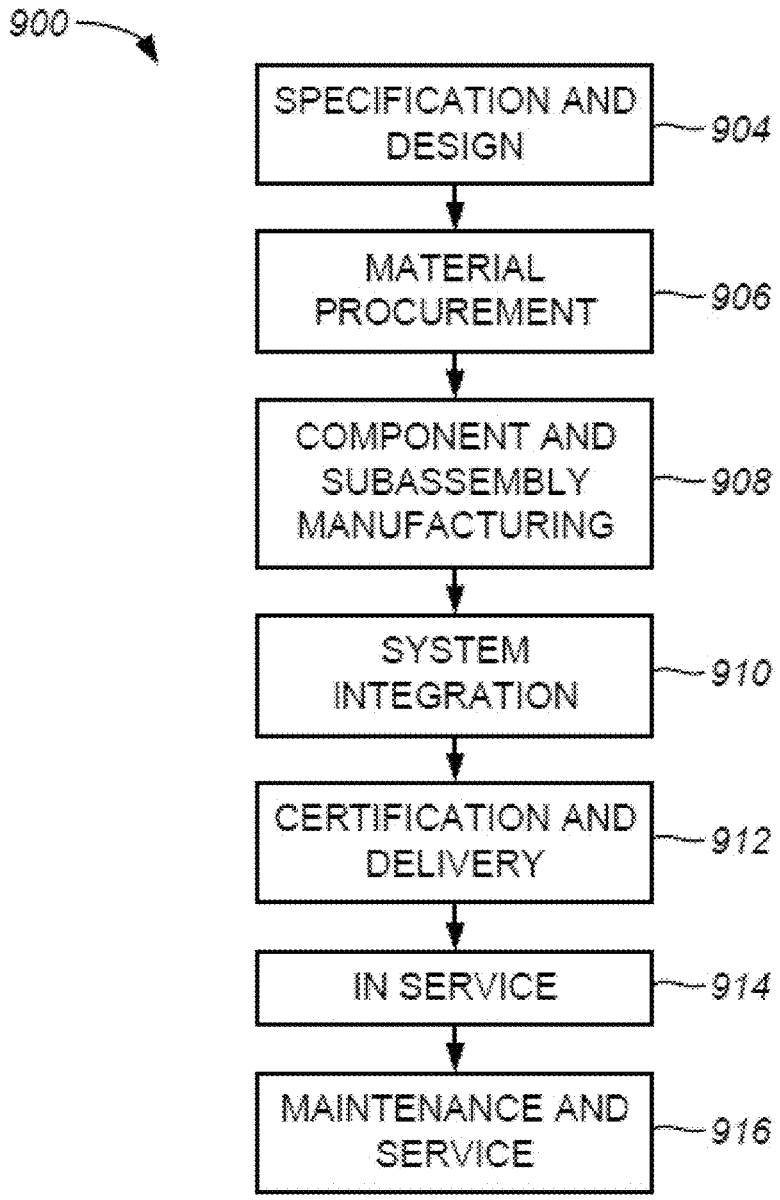
FIG. 5 illustrates allow chart of an example of an aircraft production and service methodology, in accordance with some embodiments.
Figure 6:
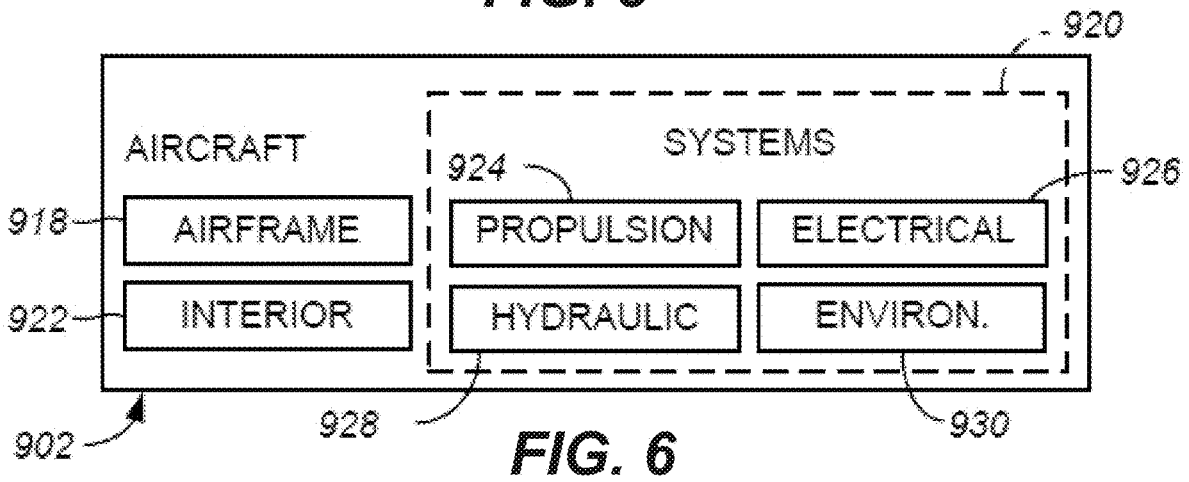
FIG. 6 illustrates a block diagram of an example of an aircraft, in accordance with some embodiments.

Accordingly, embodiments of the disclosure may be described in the context of aircraft manufacturing and service method 900 as shown in FIG. 5 and aircraft 902 as shown in FIG. 6. During pre-production, illustrative method 900 may include the specification and design 904 of aircraft 902 and material procurement 906. During production, component and subassembly manufacturing 908 and system integration 910 of aircraft 902 takes place. Thereafter, aircraft 902 may go through certification and delivery 912 in order to be placed in service 914. While in service by a customer, aircraft 902 is scheduled for routine maintenance and service 916 (which may also include modification, reconfiguration, refurbishment, and so on).

Each of the processes of method 900 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 6, aircraft 902 produced by illustrative method 900 may include airframe 918 with plurality of systems 920 and interior 922. Examples of high-level systems 920 include one or more of propulsion system 924, electrical system 926, hydraulic system 928, and environmental system 930. Any number of other systems may be included. Although an aerospace example is shown, the principles of the embodiments disclosed herein may be applied to other industries, such as the automotive industry.

Apparatus and methods embodied herein may be employed during any one or more of the stages of production and service method 900. For example, components or subassemblies corresponding to component and subassembly manufacturing 908 may be fabricated or manufactured in a manner like components or subassemblies produced while the aircraft 902 is in service. Also, one or more apparatus embodiments, method embodiments, or a combination thereof may be utilized during component and subassembly manufacturing 908 and system integration 910, for example, by substantially, expediting assembly of or reducing the cost of aircraft 902. Similarly, one or more of apparatus embodiments, method embodiments, or a combination thereof may be utilized while aircraft 902 is in service, for example and without limitation, to maintenance and service 916.

CONCLUSION

Although the foregoing concepts have been described in some detail for purposes of clarity of understanding, it will be apparent that certain changes and modifications may be practiced within the scope of the appended claims. It should be noted that there are many alternative ways of implementing the processes, systems, and apparatus.

Accordingly, the present examples are to be considered as illustrative and not restrictive.

Illustrative, non-exclusive examples of inventive features according to present disclosure are described in following enumerated paragraphs:

A1. Induction heating cell 100 for processing part 190, induction heating cell 100 comprising:

die 110, configured to receive part 190;

induction heater 130, configured to generate a magnetic field and heat part 190 while processing part 190; and bladder 120, configured to applying a uniform pressure to part 190, wherein:

bladder 120 comprises flat portions 124 and expansion feature 126, disposed between flat portions 124 extending in a direction substantially perpendicular to flat portions 124;

flat portions 124 are configured to contact and exert pressure on part 190 while processing part 190; and expansion feature 126 has a height in direction substantially perpendicular to the surface of flat portions 124, the height configured to change while heating part 190.

A2, Induction heating cell 100 according to paragraph A1, wherein the distance between flat portions 124, separated by expansion feature 126, is configured to change while heating part 190.

A3. Induction heating cell 100 according to paragraphs A1-A2, wherein flat portions 124 are configured to at least partially transition into expansion feature 126 while heating part 190.

A4. Induction heating cell 100 according to paragraphs A1-A3, wherein flat portions 124 and expansion feature 126 are monolithic.

A5. Induction heating cell 100 according to paragraphs A1-A4, wherein flat portions 124 and expansion feature 126 are formed by a continuous sheet.

A6. Induction heating cell 100 according to paragraphs A1-A5, wherein bladder 120 is formed from a metal or a metal alloy.

A7. Induction heating cell 100 according to paragraphs A1-A6, wherein expansion feature 126 has one of a trapezoid cross-sectional shape or a loop cross-sectional shape.

A5. Induction heating cell 100 according to paragraphs A1-A7, further comprising a caul 140 directly interfacing flat portions 124 of bladder 120.

A9, Induction heating cell 100 according to paragraph A8, wherein caul 140 and expansion feature 126 form expansion pocket 128, isolated by caul 140 from part 190.

A10. Induction heating cell 100 according to paragraphs A8-A9, wherein caul 140 is a continuous sheet overlapping with multiple expansion features, comprising expansion feature 126.

B1. Method of processing 400 part 190, method of processing 400 comprising:

step of positioning 410 part 190 between die 110 and bladder 120 of induction heating cell 100;

step of applying 430 pressure to part 190 using die 1100 and bladder 120; and step of heating 440 part 190 using induction heater 130 of induction heating cell 100, wherein, during step of heating 440, the overall length increase of part 190 in one direction is substantially identical to an overall length increase of bladder 120 in same irection.

B2. Method of processing 400 according to paragraph B1, wherein the CTE of bladder 120 is different from the CTE of part 190.

B3. Method of processing 400 according to paragraphs B1-B2, wherein the CTE of bladder 120 is at least two times greater than the CTE of part 190.

B4. Method of processing 400 according to paragraphs B1-B3, wherein bladder 120 is formed from a metal or a metal alloy, and wherein part 190 is a composite part.

B5. Method of processing 400 according to paragraphs B1-B4, wherein part 190 comprises a carbon reinforced organic matrix composite.

B6. Method of processing 400 according to paragraphs B1-B5, wherein:

bladder 120 comprises flat portions 124 and expansion feature 126, disposed between flat portions 124 extending in a direction substantially perpendicular to the surface of flat portions 124;

flat portions 124 contact and apply pressure on part 190;

expansion feature 126 has a height in direction substantially perpendicular to the surface flat portions 124; and the height of expansion feature 126 changes during step of heating 440 part 190.

B7. Method of processing 400 according to paragraphs B1-B6, wherein the distance between flat portions 124, separated by expansion feature 126, changes during step of heating 440 part 190.

B8. Method of processing 400 according to paragraphs B1-B7, wherein flat portions 124 at least partially transition into expansion feature 126 while during step of heating 440 part 190.

B9. Method of processing 400 according to paragraphs B1-B8, wherein flat portions 124 and expansion feature 126 are monolithic.

B10. Method of processing 400 according to paragraphs B1-B9, wherein flat portions 124 and expansion feature 126 are formed by a continuous sheet.

B11. Method of processing 400 according to paragraphs B1-B10, wherein the cross-sectional shape of expansion feature 126 changes during step of heating 440 part 190.

B12. Method of processing 400 according to paragraph B1-B11, wherein induction heating cell 100 further comprises caul 140 disposed between part 190 and expansion feature 126.

B13. Method of processing 400 according to paragraph B12, wherein caul 140 directly interfaces part 190.

B14. Method of processing 400 according to paragraphs B12-B13, wherein caul 140 is disposed between flat portions 124 and part 190.

B15. Method of processing 400 according to paragraphs B1-23, wherein flat portions 124 directly interface bladder 120.

B16. Method of processing 400 according to paragraphs B22, wherein caul 140 and expansion feature 126 form an expansion pocket 128, isolated by caul 140 from part 190.

What is claimed is:

1. An induction heating cell for processing a part, the induction heating cell comprising:

a die, configured to receive the part;

an induction heater, configured to generate a magnetic field and heat the part, while processing the part using the induction heating cell; and a bladder, configured to apply a uniform pressure to the part, wherein:

the bladder comprises flat portions and an expansion feature, disposed between the flat portions and extending into an interior of a bladder in a direction substantially perpendicular to the flat portions;

the flat portions and the expansion feature are monolithic and formed by a continuous sheet;

the flat portions are configured to contact and exert pressure on the part while processing the part using the induction heating cell;

the expansion feature has a height in the direction substantially perpendicular to the flat portions; and the height of the expansion feature is configured to change while heating and cooling the part.

2. The induction heating cell according to claim 1, wherein a distance between the flat portions, separated by the expansion feature, is configured to change while heating the part.

3. The induction heating cell according to claim 1, wherein the flat portions are configured to at least partially transition into the expansion feature while heating the part.

4. The induction heating cell according to claim 1, wherein the bladder is formed from a metal or a metal alloy.

5. The induction heating cell according to claim 1, wherein the expansion feature has one of a trapezoid cross-sectional shape or a loop cross-sectional shape.

6. The induction heating cell according to claim 1, further comprising a caul directly interfacing the flat portions of the bladder.

7. The induction heating cell according to claim 6, wherein the caul and the expansion feature form an expansion pocket, isolated by the caul from the part.

8. The induction heating cell according to claim 6, wherein the caul is a continuous sheet overlapping with multiple expansion features, comprising the expansion feature.

9. A method of processing a part, the method of processing comprising:

a step of positioning the part between a die and a bladder of an induction heating cell, wherein:

the bladder comprises flat portions and an expansion feature, disposed between the flat portions and extending into an interior of a bladder in a direction substantially perpendicular to the flat portions; and the flat portions and the expansion feature are monolithic and formed by a continuous sheet;

a step of applying pressure to the part using the die and the flat portions of the bladder; and a step of heating the part using an induction heater of the induction heating cell, wherein, during the step of heating, an overall length increase of the part in one direction is substantially identical to an overall length increase of the bladder in the same direction and a height of the expansion feature in the direction substantially perpendicular to the flat portions increases.

10. The method of processing according to claim 9, wherein a coefficient of thermal expansion (CTE) of the bladder is different from a CTE of the part.

11. The method of processing according to claim 10, wherein the CTE of the bladder is at least two times greater than the CTE of the part.

12. The method of processing according to claim 10, wherein the bladder is formed from a metal or a metal alloy, and wherein the part is a composite part.

13. The method of processing according to claim 9, wherein the part comprises a carbon reinforced organic matrix composite.

14. The method of processing according to claim 9, wherein a distance between the flat portions, separated by the expansion feature, changes during the step of heating the part.

15. The method of processing according to claim 9, wherein the flat portions at least partially transition into the expansion feature while during the step of heating the part.

16. The method of processing according to claim 9, wherein a cross-sectional shape of the expansion feature changes during the step of heating the part.

17. The method of processing according to claim 9, wherein the induction heating cell further comprises a caul, disposed between the part and the expansion feature.

18. The method of processing according to claim 17, wherein the caul directly interfaces the part.

19. The method of processing according to claim 18, wherein the caul is disposed between the flat portions and the part.

20. The method of processing according to claim 18, wherein the flat portions directly interface the bladder.

21. The method of processing according to claim 17, wherein the caul and the expansion feature form an expansion pocket, isolated by the caul from the part.

22. The induction heating cell of claim 1, wherein the flat portions have a curvature of less than 100 millimeters.

23. The induction heating cell of claim 1, wherein the expansion feature is a part of multiple expansion features, evenly distributed in one or more directions.

24. The induction heating cell of claim 23, wherein each of the multiple expansion features is disposed between a pair of adjacent flat portions, forming a plurality of flat portions, the flat portions being a part of the plurality of flat portions.

25. The induction heating cell of claim 1, wherein the height of the expansion feature is configured to increase while heating the part.

26. The induction heating cell of claim 1, wherein the height of the expansion feature is configured to decrease while cooling the part.

* * * * *